United States Patent [19]

Summers et al.

[11] Patent Number: 4,743,032

[45] Date of Patent: May 10, 1988

[54] MULTIPLE TARGET MECHANISM

[75] Inventors: Graham F. Summers; Thomas W. Whittaker, both of Albury, Australia

[73] Assignee: ATA Training Aids Pty. Ltd., New South Wales, Australia

[21] Appl. No.: 171

[22] Filed: Jan. 2, 1987

[51] Int. Cl.[4] ..... F41J 5/06; F41J 7/02

[52] U.S. Cl. ..... 273/372; 273/406

[58] Field of Search ..... 273/371, 372, 406, 391, 273/392

[56] References Cited

U.S. PATENT DOCUMENTS

| | | | |
|---|---|---|---|
| Re. 30,013 | 5/1979 | Knight | 273/369 |
| 631,175 | 8/1899 | Parnall | 273/406 |
| 809,796 | 1/1906 | Grabosch | 273/406 |
| 879,670 | 2/1908 | Petry | 273/406 |
| 3,034,788 | 5/1962 | Cauble | 273/406 X |
| 3,233,904 | 2/1966 | Gillam et al. | 273/371 |
| 4,330,129 | 5/1982 | Meredith | 273/372 |
| 4,357,531 | 11/1982 | Knight | 235/400 |

FOREIGN PATENT DOCUMENTS 103716 7/1899 Fed. Rep. of Germany .

*Primary Examiner*—Anton O. Oechsle

*Attorney, Agent, or Firm*—Bacon & Thomas

[57] ABSTRACT

A mechanism is disclosed for presenting a multiplicity of targets to a shooter in a firing range. The mechanism has a plurality of generally planar targets, each attached to a crank arm which, in turn, is attached to an actuating device. The device has an extendable and retractable ram which causes the crank arm to pivot during extension or retraction such that the target is moved between a lowered position, in which it is not visible to the shooter, to a raised position in which the target is visible to the shooter. The mechanism includes a remote control device to actuate one or more of the targets to minimize the presence of any personnel in a downrange position.

10 Claims, 3 Drawing Sheets

MULTIPLE TARGET MECHANISM

BACKGROUND OF THE INVENTION

In order to learn or maintain marksmanship capabilities, a shooter must, of course, practice as much as possible. Typically, such practice occurs at a firing range wherein the shooter may fire at a target. The target may be stationary or may be mounted so as to move along a predetermined path.

It is often necessary for the shooter to fire at different sized or shaped targets. This requirement often necessitates a reduction in the shooter's practice firing time, since it is necessary for all shooting to cease while the targets are manually changed. This also requires a relatively large number of personnel located in a downrange position which exposes them to the obvious dangers.

SUMMARY OF THE INVENTION

The present invention relates to a multiple target mechanism for presenting a plurality of targets to a shooter. The targets are each attached to a crank arm which is mounted so as to pivot about an axis extending generally perpendicular to the plane of the target. An actuating device comprising a stationary cylinder having an extendable and retractable ram, is interconnected between each crank arm and a support such that expansion or contraction of the ram causes the crank arm to pivot about the pivot axis.

The support may be attached to a stationary housing located behind a mantelet or earthen embankment to protect the mechanism from stray bullets. The targets are deployed in a first or lowered position such that they are below an upper level of the mantelet or embankment and are not visible to the shooter. Remote control means may be activated so as to extend one or more of the rams, causing the crank arm to pivot approximately 90° , thereby raising the associated target into a position above the mantelet or embankment in which it is visible to the shooter. Each of the multiplicity of targets may have different shaped or different sized target silhouettes or aiming marks outlined thereon. Also, two or more targets may have only a portion of the shooting target thereon such that, when both are simultaneously made visible to the shooter, a somewhat larger shooting target is presented.

The multiple target mechanism may be utilized in conjunction with a target board or a witness screen located immediately downrange of the targets so as to provide a target background and an accurate indication of the precise location of the bullet passing through the target. Furthermore, a known projectile locating system may be mounted to the mechanism to indicate the precise path of the bullet.

DETAILED DESCRIPTION OF THE PREFERRED EMBODIMENT

Figure 1:
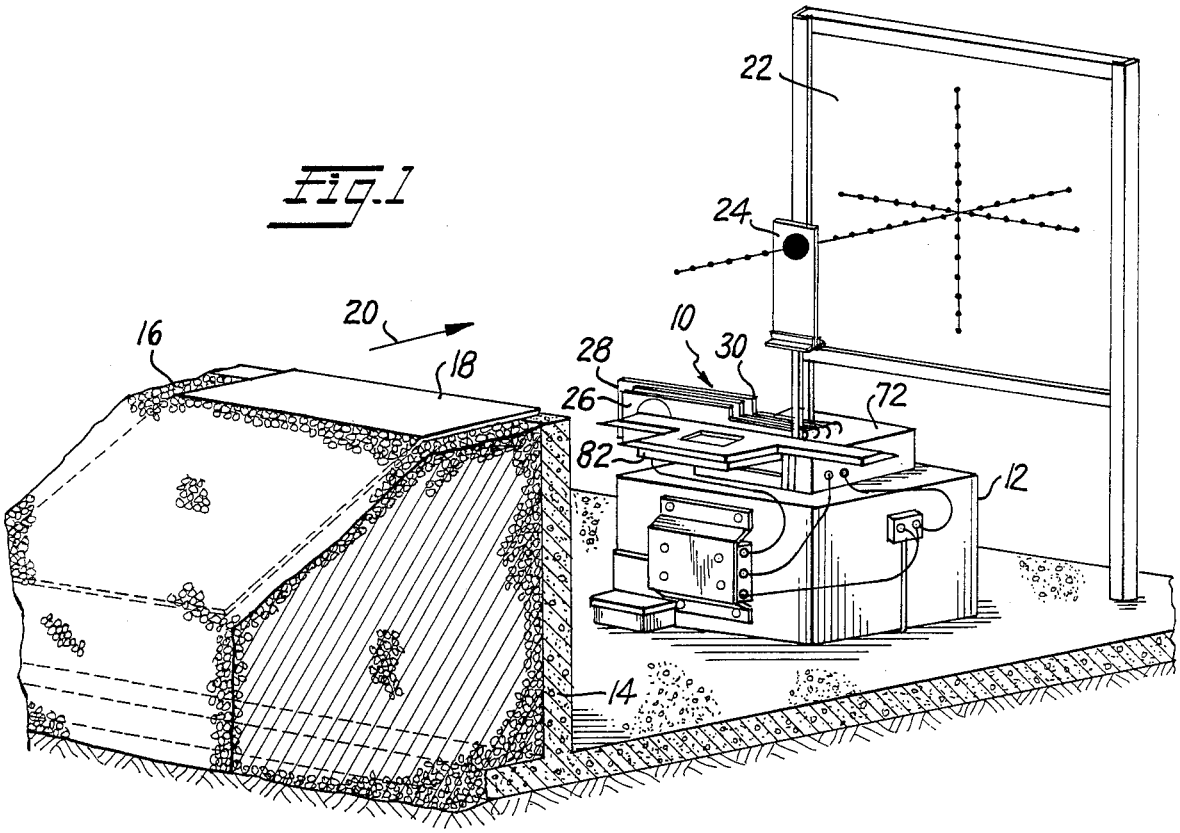
FIG. 1 is a partial perspective view of a shooting range incorporating a multiple target mechanism according to the invention.

The multiple target mechanism according to the invention is indicated at 10 and is shown in FIG. 1 disposed on a mounting structure 12, which may be concrete block or brick, located behind a reinforced concrete retaining wall 14. An embankment 16 of earth or other material is disposed on the uprange side of concrete wall 14 and may have a skid plate 18 located on its upper surface. In FIG. 1, it is to be understood that a shooter (not shown) is located to the left of embankment 16 and the path of the bullet travels in a downrange direction, as indicated by arrow 20. The height of concrete wall 14 and embankment 16 is such that the multiple target mechanism 10 is not visible to the shooter.

A target board or witness screen 22 may be located immediately downrange of the multiple target mechanism 10 so as to provide a background for the target at which the shooter is aiming. The witness screen or target board 22 may also provide a positive indication of the path of the bullet after passing through the target. Witness screen or target board 22 is mounted so as to be visible above the top of the concrete wall 14 and the embankment 16 and is substantially greater in area than targets 24, 26, 28 or 30.

Multiple target mechanism 10 has targets 24, 26, 28 and 30 located thereon and has means for moving each of the targets between a lowered position, shown by targets 26, 28 and 30 in FIG. 1, and a raised position, shown by target 24 in FIG. 1. In the lowered positions, the targets are located below the upper surface of concrete wall 14 and embankment 16 so as to be out of sight of the shooter. When raised to the exposed position, the targets are visible to the shooter as indicated by target 24 in FIG. 1. Although the mechanism is illustrated as having four targets, it is to be understood that the mechanism may incorporate any number of targets without exceeding the scope of this invention.

Figure 3:
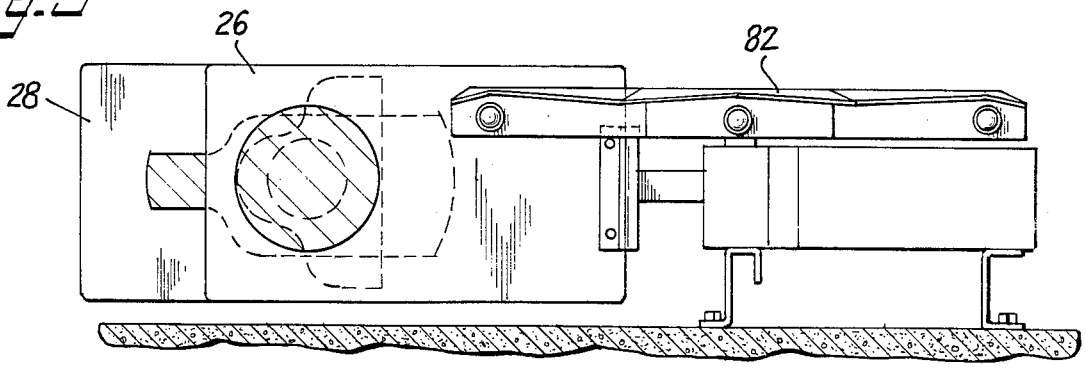
FIG. 3 is a front elevational view of the multiple target mechanism according to the invention showing the targets in their retracted positions.
Figure 4:
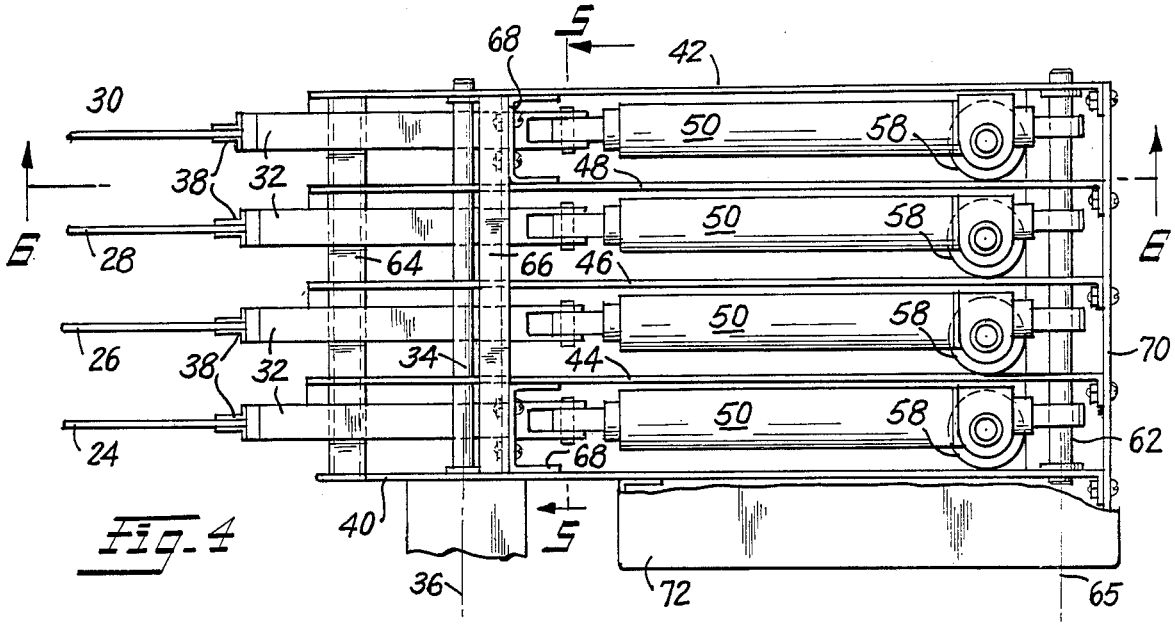
FIG. 4 is a partial top view, partially broken away, of the multiple target mechanism according to the invention showing the actuating devices.
Figure 5:
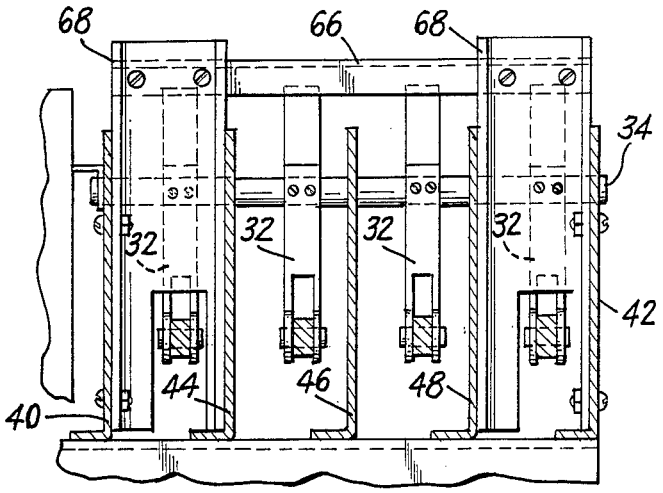
FIG. 5 is a partial, sectional view taken along line 5—5 in FIG. 4.
Figure 6:
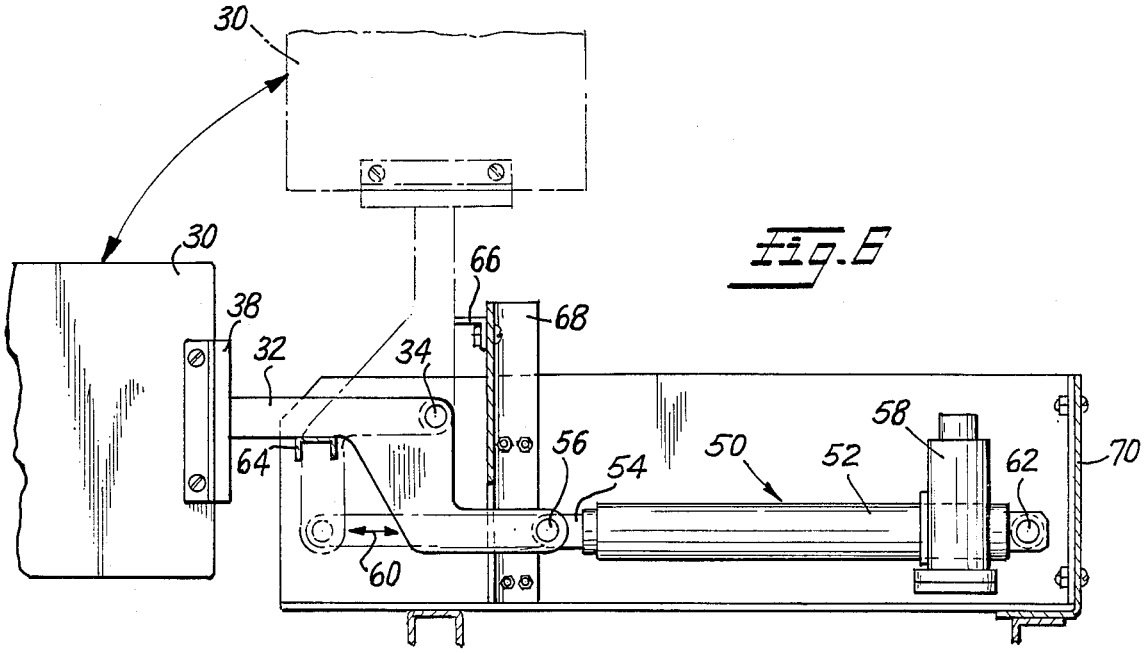
FIG. 6 is a partial, sectional view taken along line 6—6 in FIG. 4.

The mechanism for raising and lowering each of the targets is shown in FIGS. 4, 5 and 6, and comprises crank arms 32 pivotally attached to axle 34 such that they each may pivot about a common axis 36. Axle 34 and pivot axis 36 are common to all of the crank arms 32. Each of the crank arms 32 has a target attached thereto, such as by way of brackets 38. Each of the targets may be formed of plywood either with or without a rubber coating thereon to minimize reflection of shock waves generated by the bullet. Quite obviously, the precise material from which the targets are constructed, per se, forms no part of the invention, and the targets 24, 26, 28 and 30 may be fabricated of any material. Furthermore, the targets may have different sized or shaped silhouettes or aiming marks thereon to provide a variety for the shooter. As illustrated in FIGS. 1 and 3, the target silhouettes are standardized silhouettes used by the U.S. Marine Corps.

Axle 34 extends between end walls 40 and 42 to support all of the crank arms thereon. Intermediate walls 44, 46 and 48 extend generally parallel to end walls 40 and 42 and serve to further support axle 34.

Each of the crank arms 32 is connected to an actuating device 50. Each actuating device 50 comprises a stationary portion 52, which may be generally cylindrical in shape, and an extendable and retractable ram 54. The end of each ram 54 is connected to a crank arm 32 via pivoting connection 56. The actuating device 50 may be electrically actuated and have an electric motor 58 driving a worm gear (not shown) which, in turn, drivingly engages a gear threaded onto ram 54 so as to drive the ram in the direction of arrow 60 in FIG. 6. As the ram 54 extends from the stationary portion 52, it causes crank arm 32 to pivot about axle 34 in a clockwise direction into the position indicated in dashed lines in FIG. 6. This serves to raise the target associated with the crank arm from its lowered position to a raised, visible position. Quite obviously, retraction of ram 54 into stationary portion 52 causes the crank arm to pivot in a counterclockwise direction, as seen in FIG. 6, and return the target to the retracted positions. The stationary portions 52 of the actuating devices 50 are each attached to axle 62 extending along a second common axis 65 and passing through the walls 40, 42, 44, 46 and 48.

Although an electrically actuated ram is described, it is to be understood that pneumatic or hydraulic cylinders having extendable and retractable rams could also be used without exceeding the scope of this invention.

Additional support for the targets in their lowered position may be achieved by cross-brace 64, while a precise location of the targets in their raised positions may be achieved by cross-brace 66 attached to uprights 68. Sidewall 70 is attached to walls 40, 42, 44, 46 and 48. The cross-braces also serve to define the limits of travel of crank arm 32. A housing cover 72 may be placed over the structure to protect the mechanism from exposure to the elements.

Figure 7:
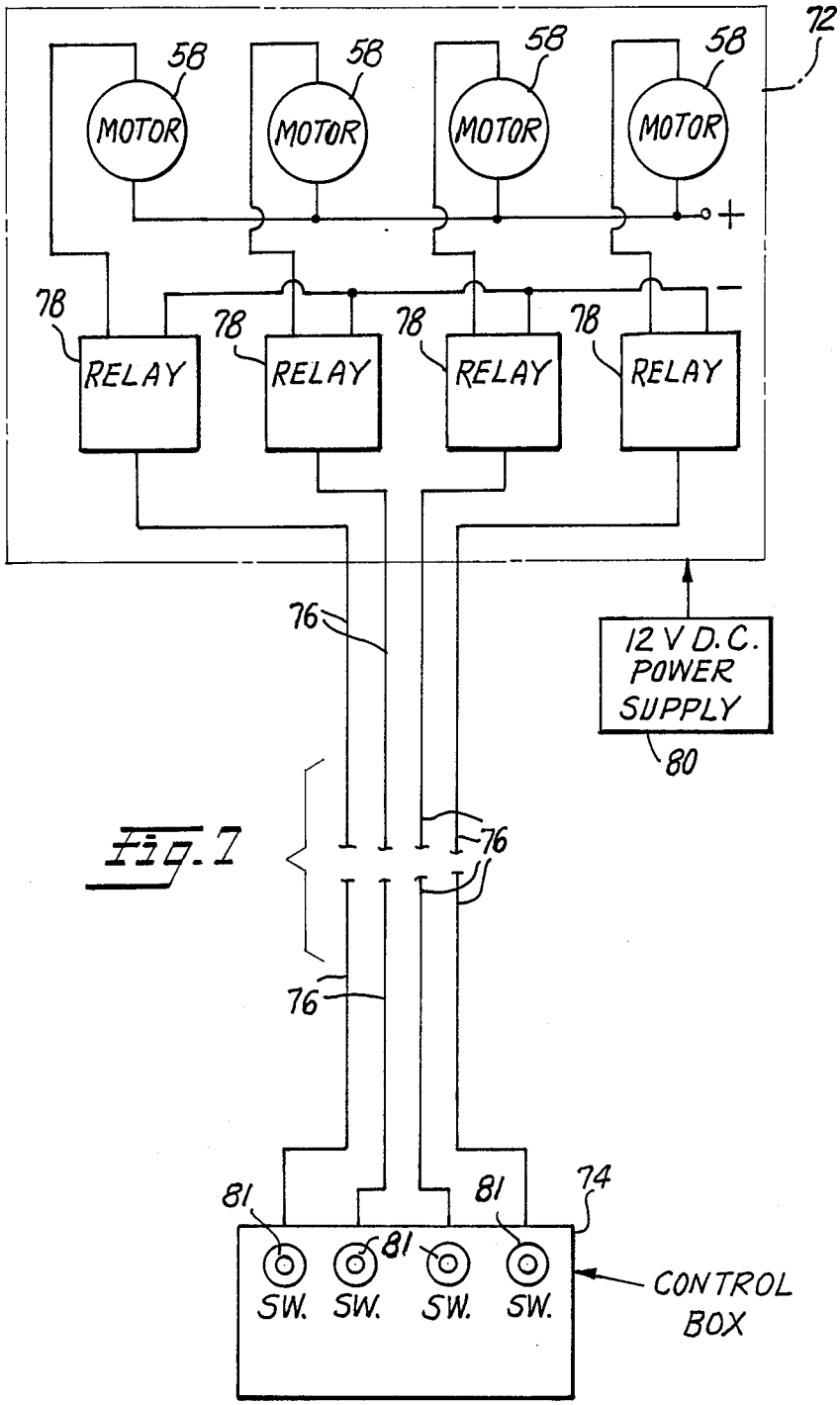
FIG. 7 is a schematic diagram of the control circuit for the multiple target mechanism according to the invention.

A schematic diagram for a typical control circuit for the target mechanism is shown in FIG. 7. Each of the actuating device motors 58 are connected to control box 74 via electrical connections 76 and relays 78. The apparatus is also connected to power supply 80, which may be a 12 V DC power supply as shown. Thus, by actuating one or more of the switches 81 on control box 74, a target may be moved between its lowered and visible positions. The control box 74 is ideally located in a remote location such that it may be actuated by personnel either off to one side or uprange of the firing position so as to minimize the exposure of such personnel to the obvious dangers of being located near the targets themselves. By minimizing the need for any downrange personnel, the device markedly reduces the dangers inherent in shooting range operation.

The multiple target mechanism according to the invention may be mounted either on top of mounting structure 12, as shown in FIG. 1, or may be mounted directly on a concrete base as shown in FIG. 3.

Figure 2:
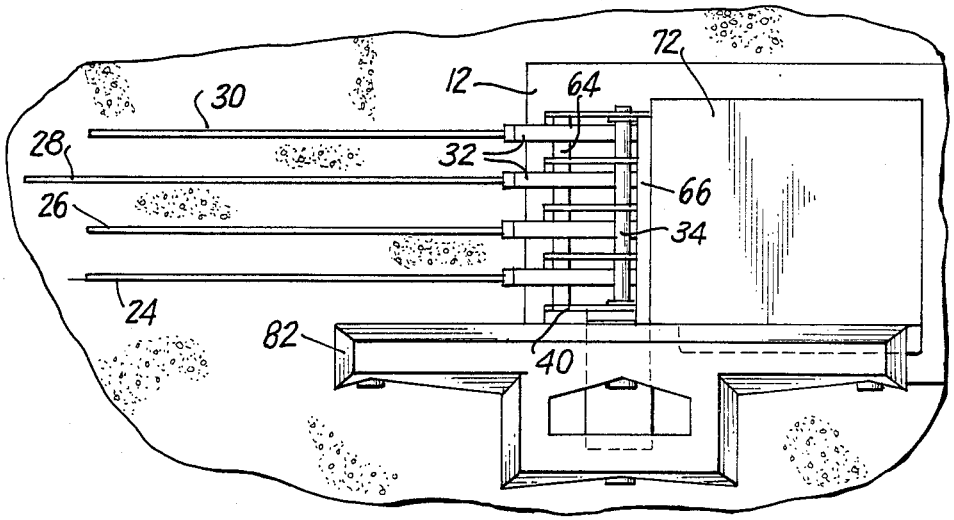
FIG. 2 is a partial, top plan view of the multiple target mechanism according to the invention.

A projectile locating system sensor assembly 82, shown in FIGS. 1, 2 and 3 may be mounted on the mechanism housing 72 as shown. This sensor assembly is utilized in conjunction with a projectile locating system such as that shown and described in U.S. Pat. No. 4,357,531 to Knight. The operation of such a projectile locating system, per se, does not form any part of the present invention.

The target mechanism according to the invention may be formed of a modular construction wherein each module comprises at least a side wall, a crank arm pivotally attached to the side wall and an actuating device. A plurality of such modules may be fastened side by side, such as shown in FIG. 4, to fabricate a target mechanism having any number of targets.

While each target has been described as having a different sized or shaped silhouette, it is possible for each individual target to have a portion of a larger target silhouette. By raising more than one of the targets to the visible position, a somewhat larger target silhouette may be presented to the shooter. It is also possible to incorporate the multiple target mechanism according to this invention on a moveable trolley which moves along a path so as to provide multiple moving targets to the shooter.

The foregoing description has been provided for illustrative purposes only and should not be construed as in any way limiting this invention, the scope of which is defined solely by the appended claims.

What is claimed is:

1. A modular, multiple target mechanism for presenting a multiplicity of targets to a shooter for firearm target practice comprising:

(a) a plurality of modules, each module comprising:
  (i) a support;
  (ii) an actuating device having a stationary portion, and an extensible and retractable ram;
  (iii) first attaching means for attaching the stationary portion to the support;
  (iv) a crank arm;
  (v) second attaching means attaching the crank arm to the support such that it pivots about an axis;
  (vi) third attaching means attaching the ram to the crank arm such that extension and retraction of the ram causes the crank arm to pivot about its axis; and,
  (vii) a generally planar target attached to the crank arm such that the plane of the target extends substantially perpendicular to the pivot axis of the crank arm; and, (b) means to fasten a plurality of modules together such that the pivot axes of the crank arms are coincident.

2. The modular, multiple target mechanism according to claim 1 further comprising remote control means connected to each activating device.

3. The modular, multiple target mechanism according to claim 1 wherein the actuating device comprises a generally cylindrical stationary portion and an electrically operated ram extendable and retractable with respect to the generally cylindrical stationary portion.

4. The modular, multiple target mechanism according to claim 1 further comprising a projectile location sensor assembly attached to at least one of the plurality of modules.

5. The modular multiple-target mechanism according to claim 1 further comprising a target board located downrange of the plurality of modules, the height and width of the target board being substantially greater than the height and width of each target.

6. The modular, multiple target mechanism according to claim 1 wherein the target of each module has a different aiming mark thereon.

7. The modular, multiple target mechanism according to claim 6 wherein the actuating device comprises a generally cylindrical stationary portion and an electrical motor driven ram extendable and retractable with respect to the generally cylindrical stationary portion.

8. The modular, multiple target mechanism according to claim 7 further comprising remote control means connected to each actuating device.

9. The modular, multiple target mechanism according to claim 8 further comprising a projectile location sensor assembly attached to at least one of the plurality of modules.

10. The modular multiple target device according to claim 9 further comprising a target board located downrange of the plurality of modules, the height and width of the target board being substantially greater than the height and width of each target.

* * * * *